US010415389B2

(12) United States Patent
Yamazaki et al.

(10) Patent No.: US 10,415,389 B2
(45) Date of Patent: Sep. 17, 2019

(54) SCROLL FLUID MACHINE WITH IMPROVED RELIABILITY AND PERFORMANCE OF COMPONENTS THEREOF

(71) Applicant: Hitachi Industrial Equipment Systems Co., Ltd., Chiyoda-ku, Tokyo (JP)

(72) Inventors: Shumpei Yamazaki, Tokyo (JP); Yoshiyuki Kanemoto, Tokyo (JP); Fuminori Kato, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 72 days.

(21) Appl. No.: 15/504,400

(22) PCT Filed: Sep. 10, 2014

(86) PCT No.: PCT/JP2014/073849
§ 371 (c)(1),
(2) Date: Feb. 16, 2017

(87) PCT Pub. No.: WO2016/038694
PCT Pub. Date: Mar. 17, 2016

(65) Prior Publication Data
US 2017/0234130 A1 Aug. 17, 2017

(51) Int. Cl.
*F03C 2/00* (2006.01)
*F03C 4/00* (2006.01)
(Continued)

(52) U.S. Cl.
CPC ..... *F01C 1/0215* (2013.01); *F01C 17/063* (2013.01); *F01C 21/008* (2013.01);
(Continued)

(58) Field of Classification Search
CPC ..... F04C 18/0215; F04C 29/0057; F04C 2240/30; F04C 2240/50; F04C 2270/17;
(Continued)

(56) References Cited

U.S. PATENT DOCUMENTS 5,556,269 A 9/1996 Suzuki et al.
6,283,737 B1 9/2001 Kazakis et al.
(Continued)

FOREIGN PATENT DOCUMENTS

JP 61-182401 A 8/1986
JP 07259759 A * 10/1995 ..... F04C 18/0215
(Continued)

OTHER PUBLICATIONS

JPH09209945A—Nakamura, Mitsuo—Scroll Type Fluid Machine—Aug. 12, 1997—English Translation (Year: 1997).*
(Continued)

*Primary Examiner* — Theresa Trieu
(74) *Attorney, Agent, or Firm* — Crowell & Moring LLP

(57) ABSTRACT

The purpose of the present invention is to provide a scroll fluid machine, the reliability of which is ensured and which can be manufactured with high productivity. The present invention provides a scroll fluid machine comprising: a stationary scroll having a spiral wrap upstanding therefrom; an orbiting scroll provided facing the stationary scroll and orbiting; a casing provided outside the orbiting scroll; a drive shaft for causing the orbiting scroll to orbit; an orbiting bearing for transmitting the rotational movement of the drive shaft to the orbiting scroll; and a plurality of rotation prevention mechanisms for preventing the orbiting scroll from rotating. The scroll fluid machine is characterized in that: the rotation prevention mechanisms have crankshafts and also have crank bearings for supporting the crankshafts; and the gap between each of the crankshafts and the corre-
(Continued)

sponding one of the crank bearings is set to be greater than the gap between the drive shaft and the orbiting bearing.

10 Claims, 3 Drawing Sheets

(51) Int. Cl.

| | |
|---|---|
| ***F04C 18/00*** | (2006.01) |
| ***F01C 1/02*** | (2006.01) |
| ***F01C 21/00*** | (2006.01) |
| ***F01C 21/10*** | (2006.01) |
| ***F04C 18/02*** | (2006.01) |
| ***F04C 29/00*** | (2006.01) |
| ***F01C 17/06*** | (2006.01) |

(52) U.S. Cl.
CPC ..... *F01C 21/10* (2013.01); *F04C 18/0215* (2013.01); *F04C 29/0057* (2013.01); *F04C 2240/30* (2013.01); *F04C 2240/50* (2013.01); *F04C 2270/17* (2013.01)

(58) Field of Classification Search
CPC .... F01C 1/0215; F01C 17/063; F01C 21/008; F01C 21/10
USPC ..... 418/55.1–55.6, 57; 464/102
See application file for complete search history.

(56) References Cited

U.S. PATENT DOCUMENTS

| | | | | |
|---|---|---|---|---|
| 2003/0223898 | A1* | 12/2003 | Fujioka | F04C 18/0215 418/55.3 |
| 2009/0246058 | A1 | 10/2009 | Komai et al. | |
| 2014/0119970 | A1* | 5/2014 | Kobayashi | F04C 18/0215 418/55.3 |

FOREIGN PATENT DOCUMENTS

| | | | | | |
|---|---|---|---|---|---|
| JP | 2594717 | B2 | | 3/1997 | |
| JP | 09209945 | A | * | 8/1997 | F04C 18/0215 |
| JP | 3767681 | B2 | | 4/2006 | |
| JP | 2009-264370 | A | | 11/2009 | |
| JP | 2011185208 | A | * | 9/2011 | F04C 18/0215 |
| JP | 2012-180840 | A | | 9/2012 | |

OTHER PUBLICATIONS

International Search Report (PCT/ISA/210) issued in PCT Application No. PCT/JP2014/073849 dated Dec. 16, 2014 with English translation (4 pages).
Japanese-language Written Opinion (PCT/ISA/237) issued in PCT Application No. PCT/JP2014/073849 dated Dec. 16, 2014 (3 pages).
Japanese-language Office Action issued in counterpart Japanese Application No. 2016-547297 dated Jun. 5, 2018 with English translation (four (4) pages).

* cited by examiner

SCROLL FLUID MACHINE WITH IMPROVED RELIABILITY AND PERFORMANCE OF COMPONENTS THEREOF

TECHNICAL FIELD

The present invention relates to a scroll fluid machine.

BACKGROUND ART

Patent Literature 1 discloses a background art of this technical field. Patent Literature 1 describes a scroll fluid machine using a pin crank as a rotation prevention mechanism, in which the pin crank is fitted into a bearing housing with a gap larger than normal gap therebetween, and is supported with an elastic body having a large frictional force, such as rubber, interposed therebetween.

CITATION LIST

Patent Literature

PATENT LITERATURE 1: JP-A-61-182401

SUMMARY OF INVENTION

Technical Problem

Since the scroll fluid machine described in Patent Literature 1 keeps the bearing in a movable state, the bearing is moved during operation. Hence, reliability and life of the bearing cannot be improved. On the other hand, if the bearing is fixed, an orbiting scroll needs to be located with high accuracy to improve reliability and life of the bearing. Hence, productivity of the parts is lowered.

The present invention has been made in view of the above problem of the conventional technique, and an object of the invention is to provide a scroll fluid machine that ensures reliability, and also improves productivity.

Solution to Problem

To solve the above problem, the present invention provides a scroll fluid machine including: a stationary scroll in which a spiral lap part is installed; an orbiting scroll that is provided opposite to the stationary scroll and orbits; a casing that is provided outside the orbiting scroll; a drive shaft that makes the orbiting scroll orbit; an orbiting bearing that transmits a rotational movement of the drive shaft to the orbiting scroll; and multiple rotation prevention mechanisms that prevent rotation of the orbiting scroll, characterized in that: the rotation prevention mechanism has a crankshaft and a crank bearing that supports the crankshaft; and a gap between the crankshaft and the crank bearing is made larger than a gap between the drive shaft and the orbiting bearing.

Advantageous Effects of Invention

The present invention can provide a scroll fluid machine that ensures reliability, and also improves productivity.

DESCRIPTION OF EMBODIMENTS

Hereinafter, embodiments of the present invention will be described with reference to the drawings.

Embodiment 1

Figure 1:
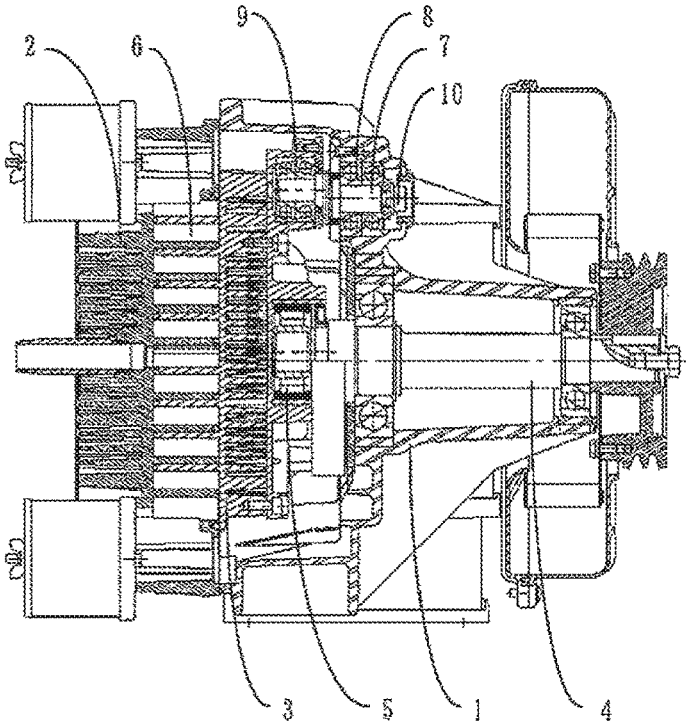
FIG. 1 is a cross-sectional view of a scroll fluid machine of Embodiment 1 of the present invention.

FIG. 1 is a cross-sectional view of an overall structure of a scroll fluid machine of Embodiment 1. A casing 1 holds bearings, and is provided outside an orbiting scroll 3. A stationary scroll 2 is provided in the casing 1, and has a spiral lap part installed. The orbiting scroll 3 is driven through a drive shaft 4, and has a spiral lap part, which forms multiple compression chambers 6 with the lap part of the stationary scroll 2, installed manner opposite to the stationary scroll 2.

The orbiting scroll 3 orbits by receiving, through an orbiting bearing 5 held by the orbiting scroll 3, rotational movement from the drive shaft 4 having an eccentric part on its tip end side. The orbital movement allows fluid to flow from the compression chamber 6 formed on the outside toward the compression chamber 6 formed on the center side, and compresses the fluid by reducing its volume.

The orbiting scroll 3 has multiple rotation prevention mechanisms (rotation prevention cranks) for preventing rotation of the orbiting scroll 3 during its orbital movement. The rotation prevention mechanism includes a rotation prevention crankshaft 7, a casing side-rotation prevention crank bearing 8 attached to the casing 1, and an orbiting scroll side-rotation prevention crank bearing 9 attached to the orbiting scroll 3.

The rotation prevention crankshaft 7 and the orbiting scroll side-rotation prevention crank bearing 9 are fixed to the orbiting scroll 3. Hence, the rotation prevention crankshaft 7 does not move inside the orbiting scroll side-rotation prevention crank bearing 9 after assembly, and reliability can be ensured. The rotation prevention crankshaft 7 is fastened by a fastening member 10 to the casing side-rotation prevention crank bearing 8 provided in the casing 1, with a gap therebetween, from the casing 1 side opposite to the orbiting scroll 3. At this time, of the orbiting bearing 5, an orbiting bearing outer race 5*a* and orbiting bearing rolling elements 5*b* are fixed to the orbiting scroll 3, an orbiting bearing inner race 5*c* is fixed to the drive shaft 4, and the parts are combined when fastening the rotation prevention crankshaft 7.

Note that although the rotation prevention crankshaft 7 is fixed by the orbiting scroll side-rotation prevention crank bearing 9 and fastened to the casing side-rotation prevention crank bearing 8 with a gap therebetween in the embodiment, instead, the rotation prevention crankshaft 7 may be fixed to the casing side-rotation prevention crank bearing 8 and fastened to the orbiting scroll side-rotation prevention crank bearing 9 with a gap therebetween. That is, the rotation prevention crankshaft 7 is fixed by one crank bearing, and fastened to the other crank bearing with a gap therebetween.

Also, although the rotation prevention crankshaft 7 is fastened by the fastening member 10 to the casing side-rotation prevention crank bearing 8 from the casing 1 side in the embodiment, it may be fastened to the orbiting scroll side-rotation prevention crank bearing 9 from the orbiting scroll 3 side.

The gap between the rotation prevention crankshaft 7 and the casing side-rotation prevention crank bearing 8 will be described with reference to FIG. 2.

Figure 2:
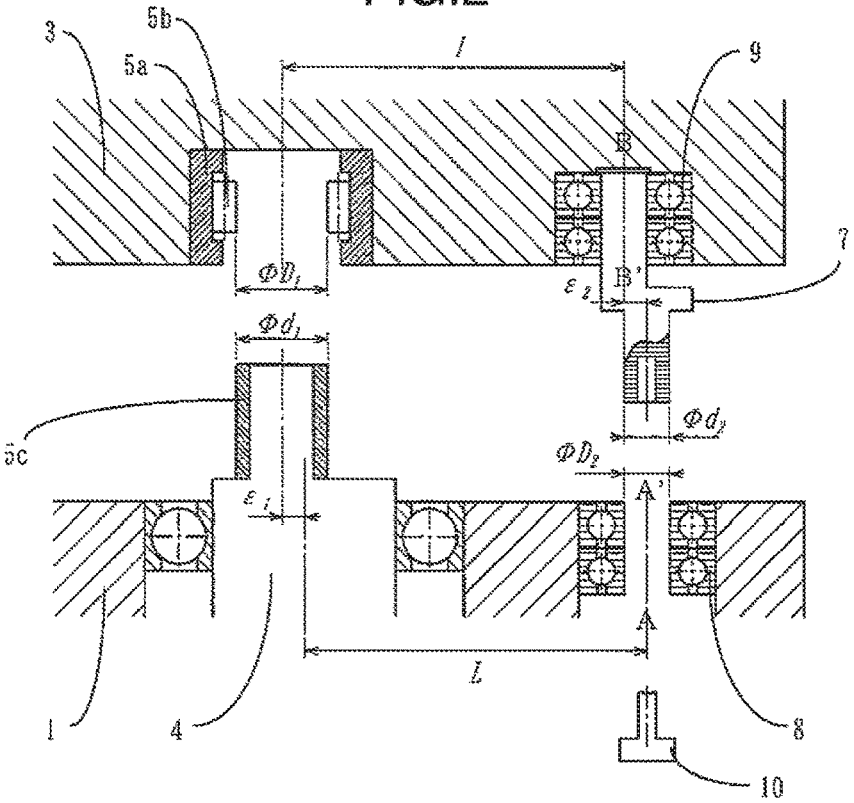
FIG. 2 is a schematic drawing of related parts of the scroll fluid machine of Embodiment 1 of the present invention.

FIG. 2 is a schematic assembly drawing of parts related to Embodiment 1. In FIG. 2, $\varepsilon_1$ is the amount of eccentricity of the drive shaft 4 required to make the orbiting scroll 3 orbit. Meanwhile, $\varepsilon_2$ is the amount of eccentricity of the rotation prevention crankshaft 7. L is the distance between the drive shaft 4 and the center of the casing side-rotation prevention crank bearing 8, and is equivalent to a distance 1 between the center of the orbiting bearing 5 and the center of the orbiting scroll side-rotation prevention crank bearing 9. Additionally, as indicated by Expression 1, the gap between the casing side-rotation prevention crank bearing 8 and the rotation prevention crankshaft 7 is made larger than a gap between the orbiting bearing inner race 5*c* and the orbiting bearing rolling elements 5*b*.

$$(\varphi D_2-\varphi d_2)>(\varphi D_1-\varphi d_1) \quad \text{(Expression 1)}$$

At this time, an orbiting radius $\varepsilon_2'$ of the rotation prevention crank is the distance from a center A-A' of the casing side-rotation prevention crank bearing 8 to a center B-B' of the orbiting scroll side-rotation prevention crank bearing 9, and is therefore expressed by the following Expression 2.

$$\varepsilon_2'=\varepsilon_1\pm(\varphi D_1-\varphi d_1)/2+(L-1)=\varepsilon_1\pm(\varphi D_1-\varphi d_1)/2 \quad \text{(Expression 2)}$$

According to Expression 2, the orbiting radius $\varepsilon_2'$ of the rotation prevention crankshaft 7 is not influenced by the amount of eccentricity $\varepsilon_2$ of the rotation prevention crankshaft 7.

Here, if the orbiting radius $\varepsilon_2'$ of the rotation prevention crankshaft 7 is influenced by the amount of eccentricity $\varepsilon_2$ of the rotation prevention crankshaft 7, an excessive load is applied on the rotation prevention crankshaft 7 unless the amount of eccentricity $\varepsilon_2$ of the rotation prevention crankshaft 7 is designed with high accuracy. Accordingly, in order to improve reliability and life of the rotation prevention crankshaft 7, accuracy of the amount of eccentricity $\varepsilon_2$ of the rotation prevention crankshaft 7 needs to be increased, and therefore productivity is lowered.

Meanwhile, in the embodiment, the gap between the casing side-rotation prevention crank bearing 8 and the rotation prevention crankshaft 7, and the gap between the orbiting bearing inner race 5*c* and the orbiting bearing rolling elements 5*b* are designed to satisfy Expressions 1 and 2. Hence, both productivity, and reliability and life of the rotation prevention crankshaft 7 can be achieved.

According to (Expression 1) and (Expression 2), the following (Expression 3) is true.

$$|\varphi D_2-\varphi d_2|/2>|\varepsilon_2'-\varepsilon_1| \quad \text{(Expression 3)}$$

Specifically, the gap between the casing side-rotation prevention crank bearing 8 and the rotation prevention crankshaft 7 is larger than the difference between the amount of eccentricity of the drive shaft 4 and the orbiting radius of the rotation prevention crankshaft 7.

As has been described, in the embodiment, since the gap between the casing side-rotation prevention crank bearing 8 and the rotation prevention crankshaft 7 is set to satisfy Expressions 1 and 3, the orbiting radius $\varepsilon_2'$ of the rotation prevention crankshaft 7 is not influenced by the amount of eccentricity $\varepsilon_2$ of the rotation prevention crankshaft 7. Hence, reliability of the scroll fluid machine can be ensured even if the amount of eccentricity $\varepsilon_2$ of the rotation prevention crankshaft 7 is not highly accurate.

Also, since this relaxes the tolerance of a size $\varphi d_2$ and amount of eccentricity $\varepsilon_2$ of the rotation prevention crankshaft 7, the rotation prevention crankshaft 7 need not be machined with high accuracy. Hence, productivity can be improved. Additionally, since the gap is wide, assembly can be facilitated.

Also, unlike Patent Literature 1, the rotation prevention crankshaft 7 is fixed by the orbiting scroll side-rotation prevention crank bearing 9, and the rotation prevention crankshaft 7 is fastened by the fastening member 10 to the casing side-rotation prevention crank bearing 8 from the casing 1 side in the embodiment. Hence, the whole bearing is not movable even after assembly, whereby reliability can be maintained.

Embodiment 2

Figure 3:
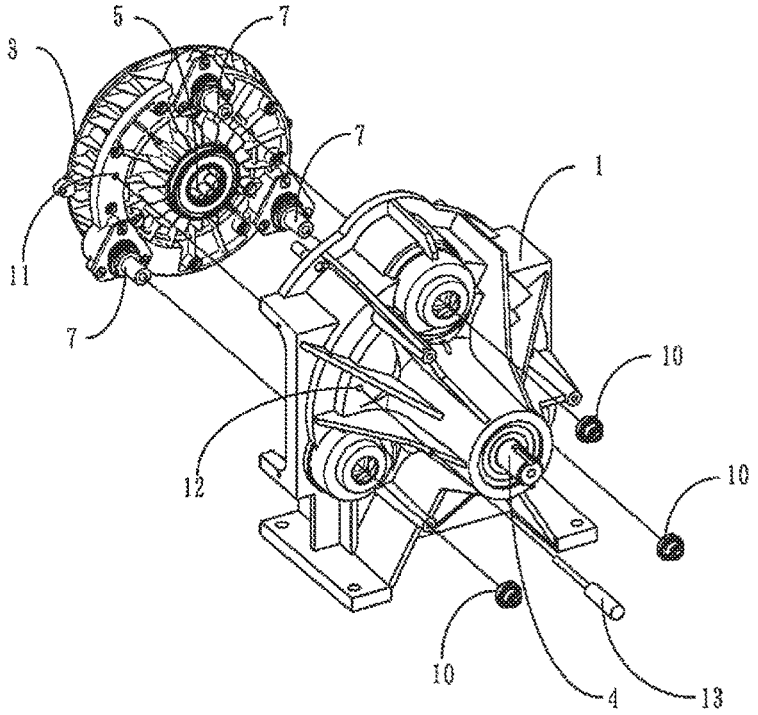
FIG. 3 is a schematic drawing of related parts of a scroll fluid machine of Embodiment 2 of the present invention.

Embodiment 2 of the present invention will be described with reference to FIG. 3. The same configurations as Embodiment 1 are assigned the same reference signs, and descriptions thereof will be omitted.

This embodiment is characterized in that in a scroll fluid machine similar to Embodiment 1, not only the dimensional relation of the aforementioned Expression 1 is satisfied, but also locating holes for locating an orbiting scroll 3 with respect to a casing 1 are provided. To be specific, the embodiment is characterized in that a locating hole 11 is provided in the casing 1, and a locating hole 12 is provided in the orbiting scroll 3 as shown in FIG. 3.

This makes it easy to locate the orbiting scroll 3 with respect to the casing 1 by using a locating pin 13, for example, when fastening a rotation prevention crankshaft 7. Accordingly, as compared to a case of not locating the orbiting scroll 3 by use of this structure, it is possible to prevent movement of the orbiting scroll 3 within a gap between an orbiting bearing inner race 5*c* and orbiting bearing rolling elements 5*b*, and a gap between a casing side-rotation prevention crank bearing 8 and the rotation prevention crankshaft 7.

In other words, in the embodiment, the orbiting scroll 3 is located with respect to the casing 1 by use of the locating holes 11, 12 and the locating pin 13, instead of the rotation prevention crankshaft 7. That is, the locating function is assigned not to the rotation prevention crankshaft 7, but to the locating holes 11, 12 and the locating pin 13.

To be specific, a clearance between the centers (radial or circumferential) of the locating holes 11, 12 after assembly is made smaller than the gap between the casing side-rotation prevention crank bearing 8 and the rotation prevention crankshaft 7.

This can ensure accuracy of locating, even if an amount of eccentricity $\varepsilon_2$ of the rotation prevention crankshaft 7 is not highly accurate. Hence, as in the case of Embodiment 1, the rotation prevention crankshaft 7 need not be machined with high accuracy, and productivity can be improved. Additionally, since the gap is wide, assembly can be facilitated.

Here, if the locating holes are provided on the radially inner side of a sliding surface between the casing 1 and the orbiting scroll 3, the locating hole 11 on the orbiting scroll 3 side needs to be closed to seal a compression chamber 6 after alignment. This hinders productivity improvement. In the embodiment, the locating holes 11, 12 are provided on the radially outer side of the sliding surface between the casing 1 and the orbiting scroll 3, to improve productivity.

As has been described, according to the embodiment, the orbiting scroll 3 can be located by use of the locating holes 11, 12 and the locating pin 13, and the amount of eccentricity of the orbiting scroll 3 can be defined regardless of the gap between the casing side-rotation prevention crank bearing 8 and the rotation prevention crankshaft 7. Hence, in addition to the effects described in Embodiment 1, the gap that may cause leakage of compressed air can be minimized while preventing contact between the stationary scroll 2 and the spiral lap part of the orbiting scroll 3, so that reliability and performance can be improved.

Note that although the locating pin 13 is inserted from the casing 1 side in the embodiment, the configuration is not limited to this, and the locating pin 13 may be inserted from the orbiting scroll 3 side for assembly.

Embodiment 3

Figure 4:
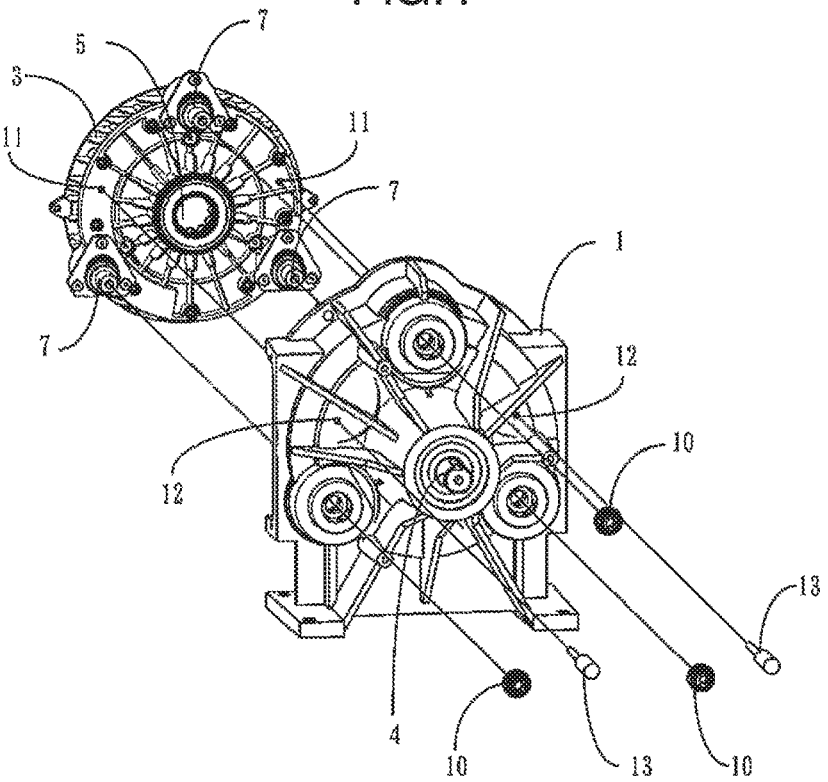
FIG. 4 is a schematic drawing of related parts of a scroll fluid machine of Embodiment 3 of the present invention.

Embodiment 3 of the present invention will be described with reference to FIG. 4. The same configurations as Embodiments 1 and 2 are assigned the same reference signs, and descriptions thereof will be omitted.

This embodiment is characterized in that in a scroll fluid machine similar to Embodiment 2, multiple pairs of the aforementioned locating hole 11 and locating hole 12 are provided. To be specific, the embodiment is characterized in that multiple locating holes 11 are provided in a casing 1, and multiple locating holes 12 are provided in an orbiting scroll 3 as shown in FIG. 4.

Here, if there was only one each of the locating holes 11, 12, the orbiting scroll 3 may be shifted about the locating holes in the rotation direction. Meanwhile, since there are at least two of the locating holes in the embodiment, shifting in the rotation direction can be prevented, and the orbiting scroll 3 can be located with even higher accuracy than Embodiment 2. Hence, it is possible to suppress deviation of the orbiting radius of the multiple rotation prevention mechanisms, so that load applied on the rotation prevention mechanisms can be reduced, and also reliability can be improved.

As has been described, in the embodiment, not only can the orbiting scroll 3 be located, but also the position thereof in the rotation direction can be determined easily. Hence, as compared to Embodiment 2, reliability and performance can be improved even more.

Note that although a locating pin 13 is inserted from the casing 1 side in the embodiment, the configuration is not limited to this, and the locating pin 13 may be inserted from the orbiting scroll 3 side for assembly.

Embodiment 4

Figure 5:
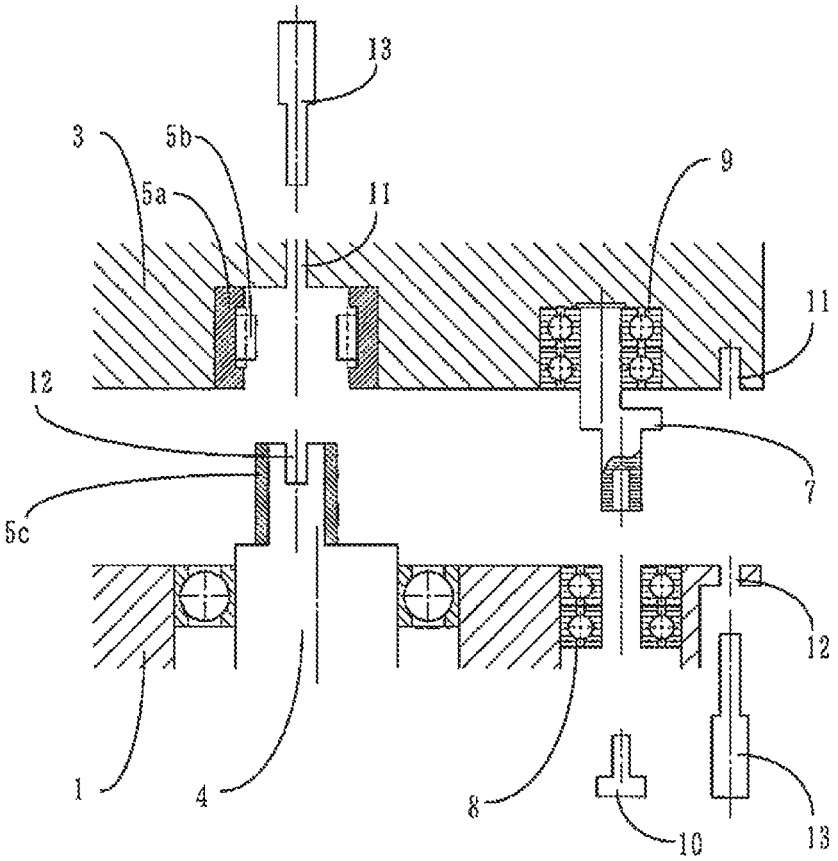
FIG. 5 is a schematic drawing of related parts of a scroll fluid machine of Embodiment 4 of the present invention.

Embodiment 4 of the present invention will be described with reference to FIG. 5. The same configurations as Embodiments 1 to 3 are assigned the same reference signs, and descriptions thereof will be omitted.

This embodiment is characterized in that in a scroll fluid machine similar to Embodiment 3, one of the aforementioned locating holes 12 provided in a casing 1 is formed in an end surface of a drive shaft 4. To be specific, the embodiment is characterized in that the locating hole 12 is provided in the end surface of the drive shaft 4, and a locating hole 11 is provided in an end surface of an orbiting scroll 3 as shown in FIG. 5.

To improve reliability and performance of a scroll fluid machine, it is necessary to increase accuracy not only when aligning lap parts of a stationary scroll 2 and the orbiting scroll 3, but also when aligning the drive shaft 4 and an orbiting bearing 5. In particular, the drive shaft 4 and the orbiting bearing 5 need to be aligned within an area where an eccentric part of the drive shaft 4 orbits.

Against this background, in the embodiment, the locating hole 12 is provided in the end surface of the eccentric part of the drive shaft 4. This facilitates alignment of a shaft center of an inner race 5*c* and the center of an outer race 5*a* of the orbiting bearing 5, regardless of an amount of eccentricity $\varepsilon_1$ of the drive shaft 4.

As has been described, according to the embodiment, the drive shaft 4 and the orbiting bearing 5 can be easily aligned with high accuracy, and load applied on the orbiting bearing 5 can be reduced. Hence, as compared to Embodiment 3, reliability of the orbiting bearing can be improved even more.

Although embodiments have been described above, the present invention is not limited to the above embodiments, and includes various modifications. For example, while the above embodiments are described in detail for the sake of a better understanding of the invention, the invention does not necessarily have to include all of the above-described configurations. The configuration of an embodiment may be partially replaced with the configuration of another embodiment, or the configuration of an embodiment may be added to the configuration of another embodiment. A different configuration may be added to, deleted from, or replaced with a part of the configuration of each embodiment.

REFERENCE SIGNS LIST

1 casing
2 stationary scroll
3 orbiting scroll
4 drive shaft
5 orbiting bearing
5*a* orbiting bearing outer race
5*b* orbiting bearing rolling elements
5*c* orbiting bearing inner race
6 compression chamber
7 rotation prevention crankshaft
8 casing side-rotation prevention crank bearing
9 orbiting scroll side-rotation prevention crank bearing
10 fastening member
11 locating hole
12 locating hole
13 locating pin

The invention claimed is:

1. A scroll fluid machine comprising:
a stationary scroll in which a spiral lap part is installed;
an orbiting scroll that is provided opposite to the stationary scroll and orbits;
a casing that is provided outside the orbiting scroll;
a drive shaft that makes the orbiting scroll orbit;
an orbiting bearing that transmits a rotational movement of the drive shaft to the orbiting scroll; and
a plurality of rotation prevention mechanisms that prevent rotation of the orbiting scroll, wherein:
the rotation prevention mechanism has a crankshaft and a crank bearing that supports the crankshaft; and a gap between the crankshaft and the crank bearing is made larger than a gap between an inner race of the orbiting bearing and rolling elements of the orbiting bearing.

2. The scroll fluid machine according to claim 1, wherein a locating hole that locates the orbiting scroll with respect to the casing is provided in each of the casing and the orbiting scroll.

3. The scroll fluid machine according to claim 2, wherein the locating hole is provided radially outwardly of a sliding surface between the casing and the orbiting scroll.

4. The scroll fluid machine according to claim 2, wherein a plurality of the locating holes are provided in each of the orbiting scroll and the casing.

5. The scroll fluid machine according to claim 2, wherein the locating hole is provided in an end surface of the drive shaft.

6. A scroll fluid machine comprising:

a stationary scroll;

an orbiting scroll that is provided opposite to the stationary scroll;

a casing that is provided outside the orbiting scroll;

a drive shaft that makes the orbiting scroll orbit;

an orbiting bearing that transmits a rotational movement of the drive shaft to the orbiting scroll; and a plurality of rotation prevention mechanisms that prevent rotation of the orbiting scroll, wherein:

the rotation prevention mechanism has a crankshaft and a crank bearing that supports the crankshaft; and a gap between the crankshaft and the crank bearing is made larger than a difference between amounts of eccentricity of the drive shaft and an orbiting radius of the crankshaft in accordance with the following formula:

$$|\varphi D_2-\varphi d_2|/2>|\varepsilon_2'-\varepsilon_1|$$

where $|\varphi D_2-\varphi d_2|/2$ denotes a gap between the crankshaft and the crank bearing, $\varepsilon_2'$ denotes a distance from a center of a casing side-rotation prevention crank bearing to a center of an orbiting scroll side-rotation prevention crank bearing, and $\varepsilon_1$ denotes an amount of eccentricity of the drive shaft to make the orbiting scroll orbit.

7. The scroll fluid machine according to claim 6, wherein a locating hole that locates the orbiting scroll with respect to the casing is provided in each of the casing and the orbiting scroll.

8. The scroll fluid machine according to claim 7, wherein the locating hole is provided radially outwardly of a sliding surface between the casing and the orbiting scroll.

9. The scroll fluid machine according to claim 7, wherein a plurality of the locating holes are provided in each of the orbiting scroll and the casing.

10. The scroll fluid machine according to claim 7, wherein the locating hole is provided in an end surface of the drive shaft.

* * * * *